US012690640B2

(12) United States Patent
Suzuki

(10) Patent No.: US 12,690,640 B2
(45) Date of Patent: Jul. 28, 2026

(54) SHOE

(71) Applicant: ASICS CORPORATION, Kobe (JP)

(72) Inventor: Chihaya Suzuki, Hyogo (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 19/236,713

(22) Filed: Jun. 12, 2025

(65) Prior Publication Data

US 2025/0380767 A1 Dec. 18, 2025

(30) Foreign Application Priority Data

Jun. 13, 2024 (JP) ..... 2024-096202

(51) Int. Cl.

*A43B 13/12* (2006.01)
*A43B 21/02* (2006.01)
*A43B 23/02* (2006.01)

(52) U.S. Cl.

CPC ..... *A43B 13/122* (2013.01); *A43B 23/0235* (2013.01); *A43B 23/024* (2013.01); *A43B 23/0245* (2013.01); *A43B 21/02* (2013.01)

(58) Field of Classification Search

CPC ..... A43B 13/122; A43B 13/0235; A43B 23/0235; A43B 23/024; A43B 23/0245; A43B 21/02

See application file for complete search history.

(56) References Cited

U.S. PATENT DOCUMENTS

2016/0206044 A1* 7/2016 Dimoff ..... A43C 1/04
2017/0020231 A1 1/2017 Hausmann et al.
2018/0213878 A1 8/2018 Bruce
2019/0313734 A1* 10/2019 Bartel ..... A43B 13/026
2019/0380424 A1* 12/2019 Tamm ..... A43B 3/106
2021/0219659 A1* 7/2021 Ventenat ..... A43B 23/042
2021/0368944 A1 12/2021 Cobb
2023/0292877 A1 9/2023 Galasso et al.
2025/0107596 A1 4/2025 Suzuki
2025/0160472 A1* 5/2025 Tamm ..... D04B 1/16

FOREIGN PATENT DOCUMENTS

WO 2023/135813 A1 7/2023

OTHER PUBLICATIONS

The extended European search report issued by the European Patent Office on Oct. 16, 2025, which corresponds to European Patent Application No. 25182320.9-1015 and is related to U.S. Appl. No. 19/236,713.

* cited by examiner

*Primary Examiner* — Alissa L Hoey
*Assistant Examiner* — Akwokwo Olabisi Redhead
(74) *Attorney, Agent, or Firm* — Studebaker Brackett PLLC

(57) ABSTRACT

A shoe includes an outsole having a ground contact surface, a midsole positioned above the outsole, an upper positioned above the outsole and the midsole and covering at least a part of a foot of a wearer, and a plurality of linear bodies disposed in the upper, extending in a first direction, and extending in a second direction intersecting the first direction. The outsole includes a side surface portion extending from the ground contact surface and covering at least a part of a side surface of the midsole. The plurality of linear bodies include a first portion connected to the side surface portion of the outsole, and a second portion which is disposed in a portion other than the first portion and in which the plurality of linear bodies adjacent to each other are caught by each other.

19 Claims, 14 Drawing Sheets

SHOE

REFERENCE TO RELATED APPLICATIONS

The present application claims priority to and incorporates by reference the entire contents of Japanese Patent Application No. 2024-096202 filed in Japan on Jun. 13, 2024.

BACKGROUND

Technical Field

The present disclosure relates to a shoe.

Background Information

A shoe including an outsole, a midsole positioned above the outsole, and an upper positioned above the outsole and the midsole and covering at least a part of a foot of a wearer is known. In recent years, in order to facilitate disassembly of the shoe after use of the shoe, a shoe in which the outsole, the midsole, and the upper can be engaged with each other has been proposed (refer to US 2023/0292877 A).

SUMMARY

However, in a shoe in which an outsole, a midsole, and an upper can be engaged with each other, the tension on the midsole and the upper is not sufficiently applied to the outsole, and fit feeling of the outsole may be deteriorated.

A shoe according to one embodiment includes an outsole having a ground contact surface, a midsole positioned above the outsole, an upper positioned above the outsole and the midsole and covering at least a part of a foot of a wearer, and a plurality of linear bodies disposed in the upper, the plurality of linear bodies extending in a first direction and extending in a second direction intersecting the first direction, wherein the outsole includes a side surface portion extending from the ground contact surface and covering at least a part of a side surface of the midsole, and the plurality of linear bodies include a first portion connected to the side surface portion of the outsole, and a second portion which is disposed in a portion other than the first portion and in which the plurality of linear bodies adjacent to each other are caught by each other.

DETAILED DESCRIPTION

Figure 1:
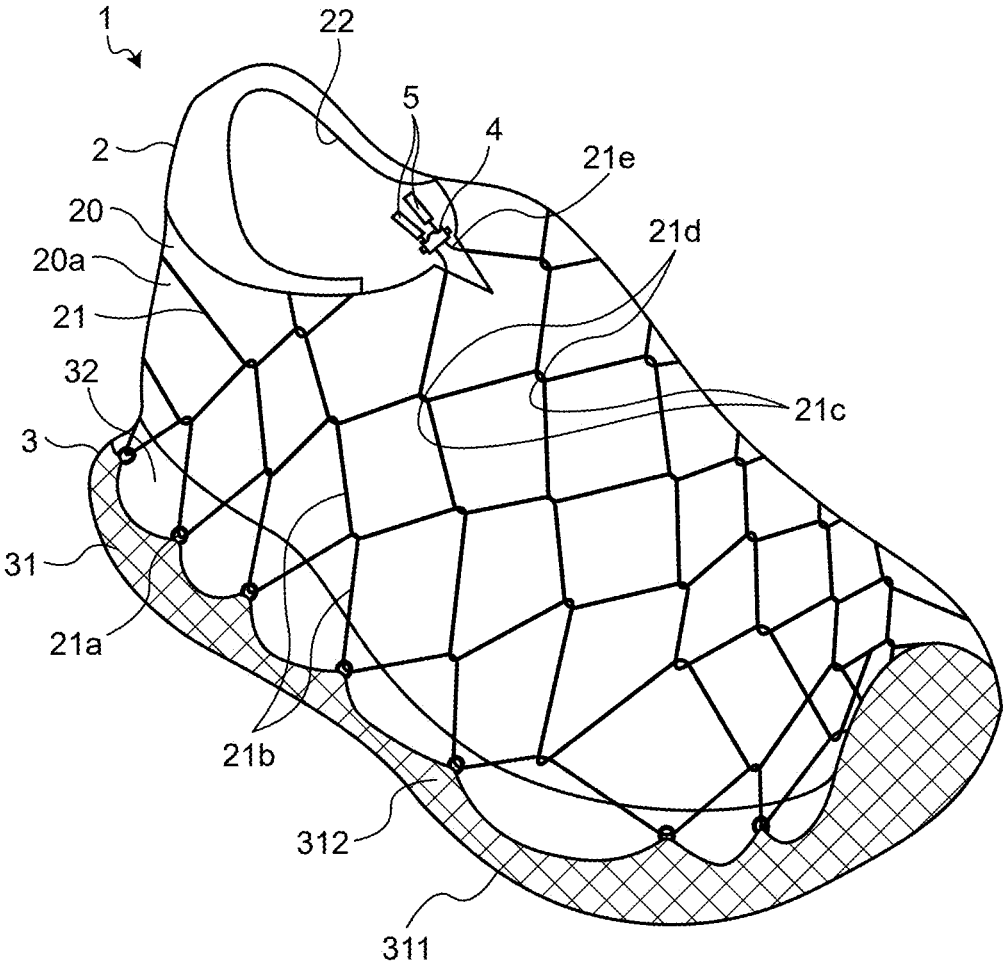
FIG. 1 is a perspective view illustrating an example of a shoe according to a first embodiment.

Hereinafter, embodiments of a shoe of the present disclosure will be described in detail with reference to the drawings. Note that the present disclosure is not limited to the embodiments. In the following description, the same portions are denoted by the same reference numerals, and redundant description will be omitted.

First Embodiment

Figure 2:
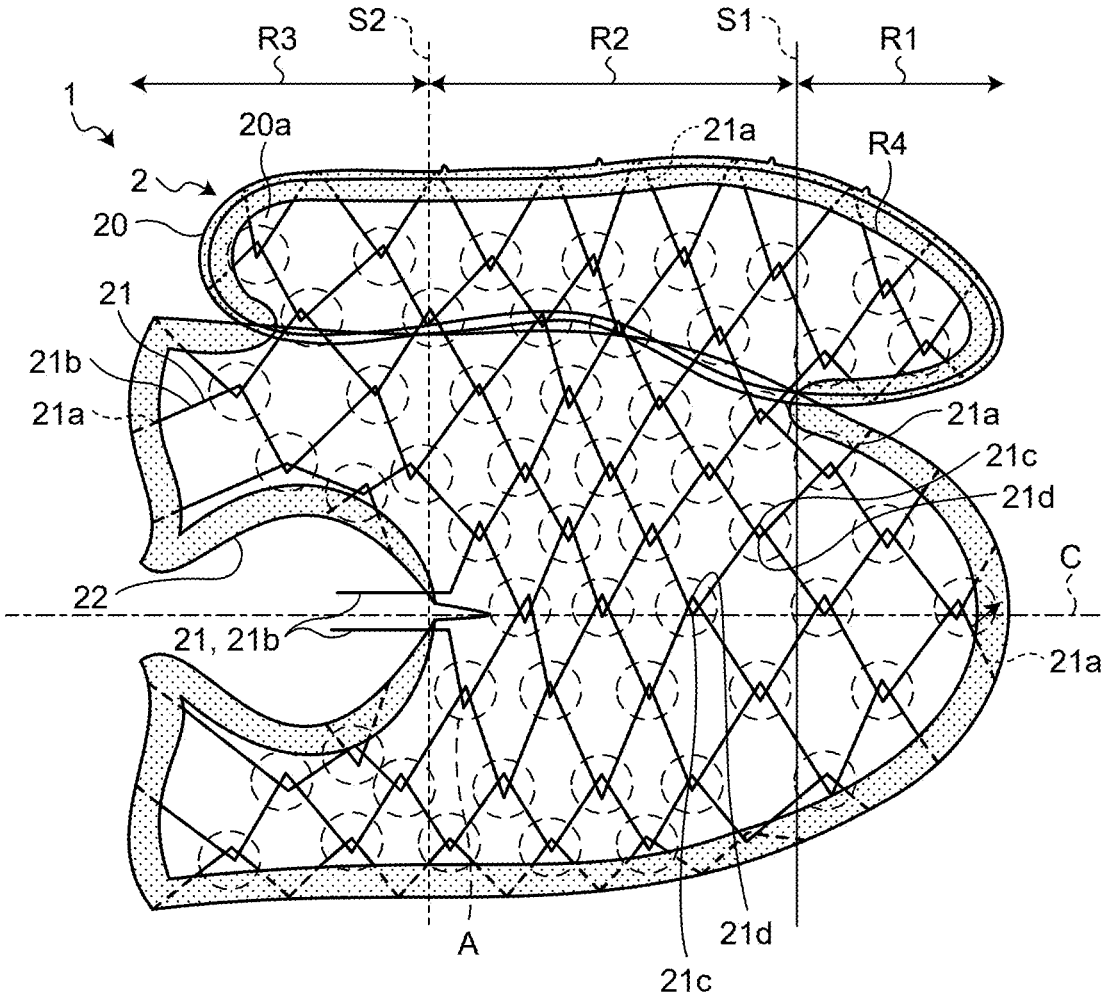
FIG. 2 is a development view illustrating an example of an upper of the shoe according to the first embodiment.

FIG. 1 is a perspective view illustrating an example of a shoe 1 according to a first embodiment. FIG. 2 is a development view illustrating an example of an upper 2 of the shoe 1 according to the first embodiment. In each figure including FIGS. 1 and 2, only the shoe 1 for the right foot is illustrated. In the present embodiment, only the shoe 1 for the right foot will be described, and the description of the shoe 1 for the left foot will be omitted.

In the following description, a direction in which a shoe center axis C (see FIG. 2), which is a perpendicular line passing through the center of the shoe 1 in a plan view of the shoe 1, extends is referred to as a foot length direction, and a direction orthogonal to the foot length direction in a plan view of the shoe 1 is referred to as a foot width direction. In the foot length direction, a direction from the heel toward the toe in the shoe 1 is referred to as a fore, and a direction from the toe toward the heel in the shoe 1 is referred to as a rear.

In addition, the median side in the anatomical normal position of the foot is referred to as the medial foot side, and the side opposite to the median side in the anatomical normal position of the foot is referred to as the lateral foot side. That is, the side closer to the median line in the anatomical normal position is referred to as the medial foot side, and the side farther from the median line in the anatomical normal position is referred to as the lateral foot side.

In addition, a vertical direction means a direction orthogonal to both the foot length direction and the foot width direction unless otherwise specified.

The shoe 1 as illustrated in FIGS. 1 and 2 are used as, for example, a running shoe, another sport shoe, a walking shoe, a climbing shoe, and a casual shoe. The shoe 1 includes an upper 2, a sole 3, a cord lock 4, and a cord tip 5.

As illustrated in FIG. 1, the upper 2 is positioned above the sole 3. The upper 2 covers at least a part of the foot of the wearer of the shoe 1. In the present embodiment, the upper 2 covers a fore foot position, a middle foot position, a rear foot position, and the sole of the foot of the wearer of the shoe 1. The upper 2 includes a cloth-like base material 20 having at least one layer 20*a*, and a plurality of linear bodies 21 disposed side by side on the base material 20 and disposed independently of each other. In the present exemplary embodiment, the upper 2 having a monosock structure will be described as an example.

The base material 20 covers at least a part of the instep of the foot. A foot insertion opening 22 for inserting the foot of the wearer is disposed on the upper portion of the base material 20. As a material of the base material 20, for example, a knitted fabric in which yarns are rolled into a chain shape and chain-shaped portions are hooked to each other to form a cloth, a woven fabric in which warp yarns and weft yarns cross each other at a certain angle to form a cloth, a braid in which three or more braid yarns cross each other and run obliquely to form a cloth, and the like are used. In order to cause the linear body 21 to run at a plurality of angles with respect to the knitting direction, warp knit is preferably used as the material of the base material 20. The material of the base material 20 is not limited to the exemplified material. Details of the base material 20 and the linear body 21 will be described later.

The sole 3 is positioned below the upper 2. The sole 3 covers the sole of the foot. The sole 3 is connected to the base material 20 by stitching, welding, bonding, a combination thereof, or the like. The sole 3 includes an outsole 31 and a midsole 32. The bottom surface of the outsole 31 serves as a ground contact surface 311 that contacts the ground. Details of the outsole 31 will be described later. The midsole 32 is positioned above the outsole 31. The midsole 32 has a cushioning property.

The cord lock 4 immovably fixes the linear body 21. For example, an insertion hole (not illustrated) through which the linear body 21 exposed to the outside of the base material 20 is inserted is disposed in the cord lock 4. The shape of the insertion hole is, for example, a circular shape. The number of the insertion holes is, for example, two.

The cord tip 5 prevents the linear body 21 from coming out of the cord lock 4. The cord tip 5 is attached to the heel side end of the linear body 21 exposed to the outside of the base material 20. The thickness of the cord tip 5 is larger than the inner peripheral dimension of the insertion hole of the cord lock 4.

As illustrated in FIG. 2, the upper 2 includes an upper fore foot portion R1 covering the fore foot position of the foot of the wearer, an upper middle foot portion R2 covering a middle foot position of the foot of the wearer, an upper rear foot portion R3 covering a rear foot position of the foot of the wearer, and an upper sole portion R4 covering a sole of the wearer. The upper fore foot portion R1, the upper middle foot portion R2, and the upper rear foot portion R3 are disposed in this order from the fore to the rear of the upper 2. The upper sole portion R4 is disposed continuously with the upper middle foot portion R2 and the upper rear foot portion R3. The upper sole portion R4 is connected to lower edges of the upper middle foot portion R2 and the upper rear foot portion R3 on the medial foot side. The upper sole portion R4 is an intermediate sole that covers a lower opening disposed by being surrounded by a lower edge of the upper fore foot portion R1, a lower edge of the upper middle foot portion R2, and a lower edge of the upper rear foot portion R3.

In the present embodiment, a line along the foot width direction passing through a position corresponding to about 25% of the dimension in the foot length direction of the upper 2 from the front end of the upper 2 is defined as a first boundary line S1, and a line along the foot width direction passing through a position corresponding to about 66% of the dimension in the foot length direction of the upper 2 from the front end of the upper 2 is defined as a second boundary line S2. The first boundary line S1 is a line substantially along the MP joint of the wearer. The second boundary line S2 is a line substantially along the Chopart joint of the wearer. The upper fore foot portion R1 is a portion positioned in front of the first boundary line S1. The upper middle foot portion R2 is a portion positioned between the first boundary line S1 and the second boundary line S2. The upper rear foot portion R3 is a portion positioned behind the second boundary line S2.

Next, the base material 20 and the linear body 21 will be described in detail.

As illustrated in FIG. 2, the base material 20 includes the upper fore foot portion R1, the upper middle foot portion R2, the upper rear foot portion R3, and the upper sole portion R4. The upper sole portion R4 is connected to the upper surface of the midsole 32 illustrated in FIG. 1 by adhesion, welding, or the like. Although not illustrated, the shoe 1 may include an insole. When the shoe 1 includes an insole, the insole is disposed on the upper sole portion R4 inside the upper 2.

When the upper 2 is assembled, the upper sole portion R4 is bent with a boundary portion between the upper middle foot portion R2 and the upper rear foot portion R3 and the upper sole portion R4 as a base point so that the upper sole portion R4 covers a lower opening surrounded by the lower edge of the upper fore foot portion R1, the lower edge of the upper middle foot portion R2, and the lower edge of the upper rear foot portion R3. In a state where the upper 2 is assembled, an edge of the upper sole portion R4 adjacent to a boundary portion between the upper middle foot portion R2 and the upper rear foot portion R3 is a medial foot side edge of the upper sole portion R4, and an edge of the upper sole portion R4 opposite to the medial foot side edge in the foot width direction is a lateral foot side edge.

The upper 2 includes a cloth-like base material 20 having one layer 20*a*. That is, the upper 2 (the base material 20 of the upper 2) has a single-layer structure. As illustrated in FIGS. 1 and 2, the plurality of linear bodies 21 are exposed on the surface of the upper 2.

The linear body 21 illustrated in FIGS. 1 and 2 is, for example, a yarn obtained by bundling a plurality of fibers, a linear resin, a twisted yarn, or the like. As a material of the linear body 21, for example, a polyurethane-based thermoplastic elastomer, polyurethane, nylon, spandex, Kevlar (registered trademark), ultra-high molecular weight polyethylene, Single Covered Yarn (SCY) or Double Covered Yarn (DCY) covered with polyurethane is used, or the like.

As illustrated in FIG. 2, the linear body 21 is disposed over the entire region of the upper fore foot portion R1, the upper middle foot portion R2, the upper rear foot portion R3, and the upper sole portion R4. That is, the linear body 21 is disposed over the entire region of the base material 20 including the heel portion of the shoe 1 and the instep portion of the shoe 1. The plurality of linear bodies 21 extend in the foot length direction and are disposed side by side in the foot width direction. In the present embodiment, the foot length direction is a first direction, and the foot width direction is a second direction intersecting the first direction. Some of the plurality of linear bodies 21 are disposed at the heel portion of the shoe 1. Some of the plurality of linear bodies 21 are disposed around the foot insertion opening 22. The linear body 21 may be disposed on a part of the upper fore foot portion R1, the upper middle foot portion R2, the upper rear foot portion R3, and the upper sole portion R4.

Each of the plurality of linear bodies 21 includes a first portion 21*a* and a second portion 21*b*. The first portion 21*a* is a portion to be connected to a connecting portion 313 (see FIGS. 7 and 8) to be described later of the outsole 31. Note that, in a case where there are a plurality of first portions 21*a*, not all of the first portions 21*a* may be connected to the connecting portion 313, and for example, some of the first portions 21*a* may be connected to the layer 20*a*. The second portion 21*b* is disposed in a portion of the linear body 21 other than the first portion 21*a*. The second portion 21*b* is a portion where the plurality of adjacent linear bodies 21 are caught by each other. In FIG. 2, a portion where the adjacent linear bodies 21 are caught with each other is surrounded by a broken line circle serving as a portion A in FIG. 2.

Figure 3:
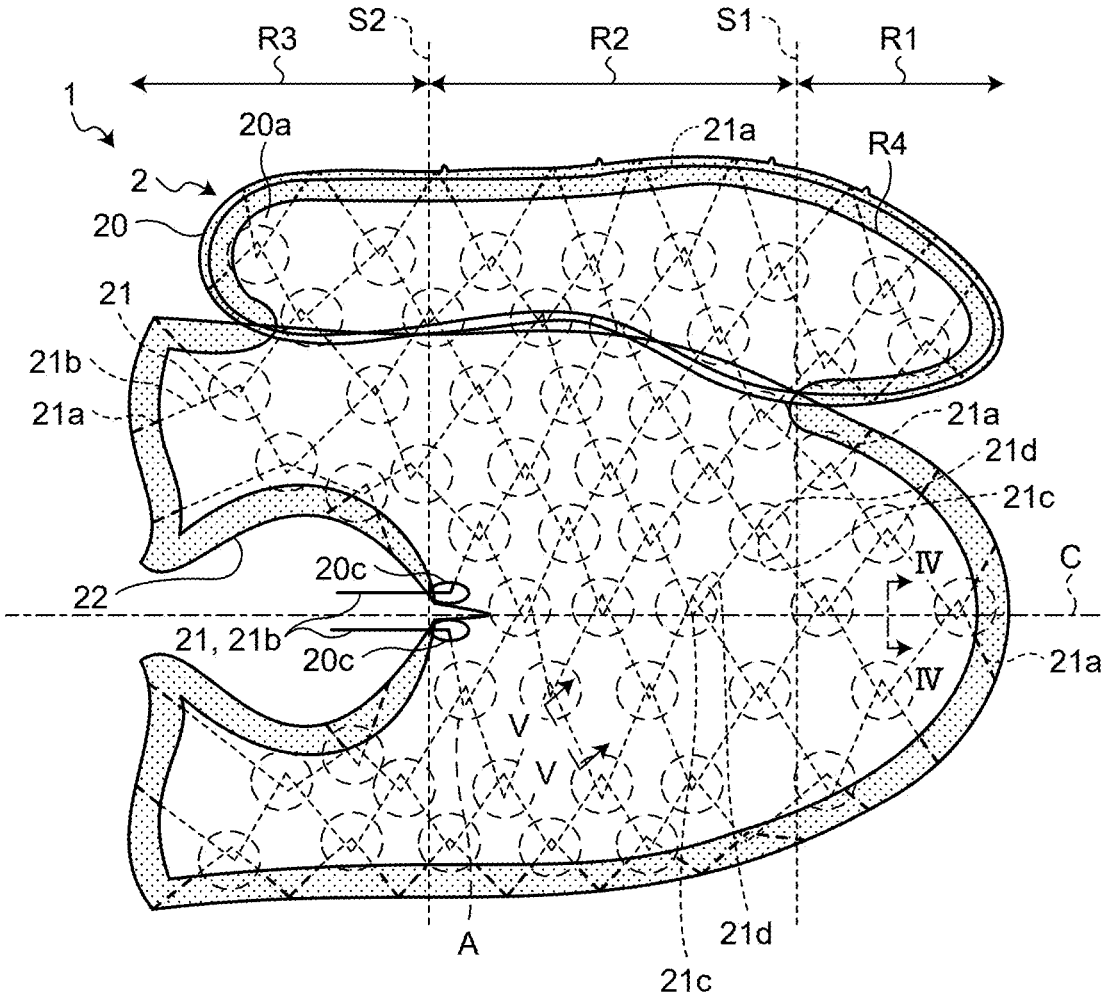
FIG. 3 is a development view illustrating another example of the upper of the shoe according to the first embodiment.
Figure 4:
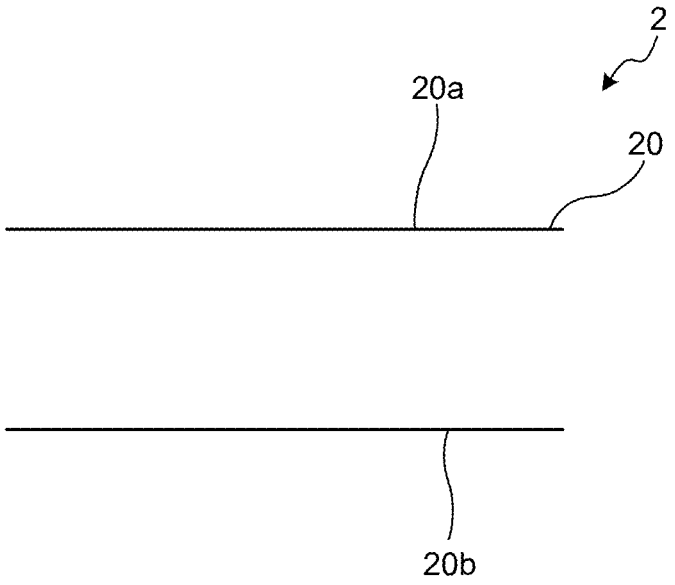
FIG. 4 is a cross-sectional view taken along line IV-IV illustrated in FIG. 3.
Figure 5:
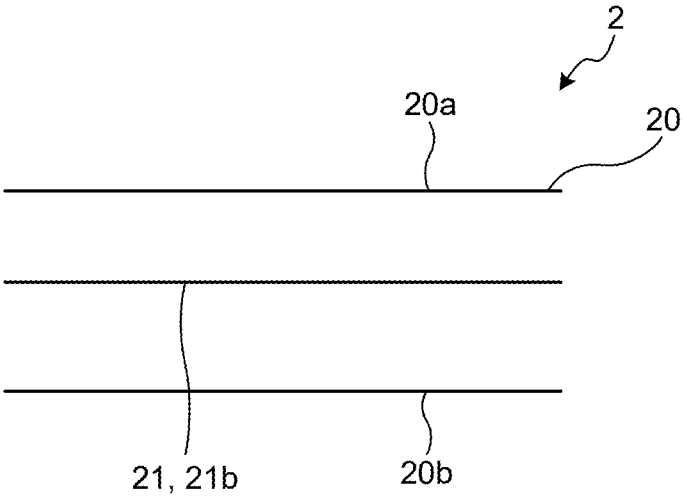
FIG. 5 is a cross-sectional view taken along line V-V illustrated in FIG. 3.

As illustrated in FIGS. 3 to 5, the upper 2 may include the cloth-like base material 20 having two or more layers. FIG. 3 is a development view illustrating another example of the upper 2 of the shoe 1 according to the first embodiment. Note that, in FIG. 3, portions denoted with the same reference numerals as those in FIG. 2 represent the same portions as those in the example illustrated in FIG. 2. Furthermore, in the description using FIG. 3, description of portions denoted with the same reference numerals as in FIG. 2 may be omitted. FIG. 4 is a cross-sectional view taken along line IV-IV illustrated in FIG. 3. FIG. 5 is a cross-sectional view taken along line V-V illustrated in FIG. 3. As illustrated in FIGS. 4 and 5, the base material 20 includes a first layer 20*a* and a second layer 20*b* disposed with a gap from the first layer 20*a*. The first layer 20*a* and the second layer 20*b* may be integrally formed of a single material.

Moreover, in the example illustrated in FIG. 3, in the upper fore foot portion R1, the upper middle foot portion R2, and the upper rear foot portion R3, the first layer 20*a* illustrated in FIGS. 4 and 5 is a layer facing the outside of the upper 2, and the second layer 20*b* is a layer facing the inside of the upper 2. In the upper sole portion R4 illustrated in FIG. 3, the second layer 20*b* illustrated in FIGS. 4 and 5 is a layer facing the inside of the upper 2, and the first layer 20*a* is a layer facing the outside of the upper 2.

As in the case of FIG. 2, the linear body 21 illustrated in FIG. 3 is, for example, a yarn obtained by bundling a plurality of fibers, a linear resin, a twisted yarn, or the like. As a material of the linear body 21, for example, a polyurethane-based thermoplastic elastomer, polyurethane, nylon, spandex, Kevlar (registered trademark), ultra-high molecular weight polyethylene, SCY or DCY covering polyurethane, or the like is used.

The linear body 21 is disposed over the entire region of the upper fore foot portion R1, the upper middle foot portion R2, the upper rear foot portion R3, and the upper sole portion R4. That is, the linear body 21 is disposed over the entire region of the base material 20 including the heel portion of the shoe 1 and the instep portion of the shoe 1. The plurality of linear bodies 21 extend in the foot length direction and are disposed side by side in the foot width direction. In the present embodiment, the foot length direction is a first direction, and the foot width direction is a second direction intersecting the first direction. Some of the plurality of linear bodies 21 are disposed at the heel portion of the shoe 1. Some of the plurality of linear bodies 21 are disposed around the foot insertion opening 22. The linear body 21 may be disposed on a part of the upper fore foot portion R1, the upper middle foot portion R2, the upper rear foot portion R3, and the upper sole portion R4.

Each of the plurality of linear bodies 21 includes a first portion 21*a* and a second portion 21*b*. The first portion 21*a* is a portion to be connected to a connecting portion 313 (see FIGS. 7 and 8) to be described later of the outsole 31. Note that, in a case where there are a plurality of first portions 21*a*, not all of the first portions 21*a* may be connected to the connecting portion 313, and for example, some of the first portions 21*a* may be connected to the first layer 20*a*. The second portion 21*b* is disposed in a portion of the linear body 21 other than the first portion 21*a*. The second portion 21*b* is a portion where the plurality of adjacent linear bodies 21 are caught by each other. In FIG. 3, a portion where the adjacent linear bodies 21 are caught with each other is surrounded by a broken line circle serving as a portion A in FIG. 3.

The first portion 21*a* of the linear body 21 is connected to a side surface portion 312 (see FIG. 1) of the outsole 31. The connection between the first portion 21*a* and the outsole 31 will be described later together with the details of the outsole 31. As illustrated in FIG. 5, the second portion 21*b* of the linear body 21 is positioned between the first layer 20*a* and the second layer 20*b*.

Figure 6:
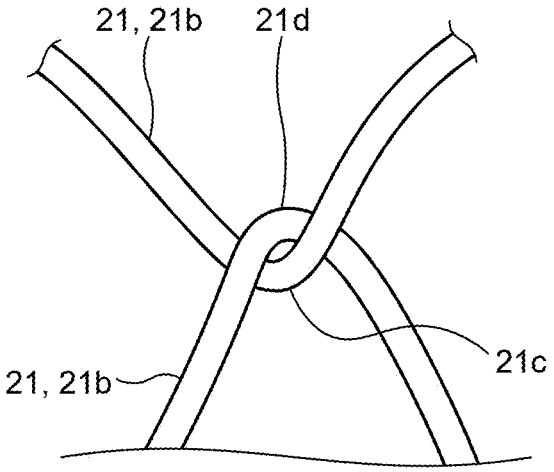
FIG. 6 is an enlarged view of a portion A illustrated in FIGS. 2 and 3.

FIG. 6 is an enlarged view of a portion A illustrated in FIGS. 2 and 3. As illustrated in FIG. 6, the second portion 21*b* of the linear body 21 is disposed in a portion other than the first portion 21*a*. The second portions 21*b* of the adjacent linear bodies 21 are caught with each other. As illustrated in FIGS. 2 and 3, each linear body 21 extends, for example, in a zigzag shape alternately protruding from the fore toward the rear to one side and the other side in the foot width direction.

In the second portion 21*b* of the linear body 21, a first hook portion 21*c* to be hooked to another linear body 21 disposed on one side along the foot width direction and a second hook portion 21*d* to be hooked to another linear body 21 disposed on the other side along the foot width direction are alternately disposed in the foot length direction. In the adjacent linear bodies 21, one of the first hook portion 21*c* and the second hook portion 21*d* is hooked with the other. In the present exemplary embodiment, linear bodies 21 are disposed such that a portion surrounded by two adjacent linear bodies 21 (second portion 21*b*) forms a rhombus.

As illustrated in FIG. 1, at least one of the plurality of linear bodies 21 has a third portion 21*e* that applies tension to the upper 2 to the outsole 31 in a state of being pulled from the fore to the rear of the shoe 1. The third portion 21*e* is disposed in at least one end portion of the linear body 21 along the length direction.

In the example illustrated in FIG. 3, a hole 20*c* for exposing the second portion 21*b* of the linear body 21 to the outside of the first layer 20*a* is disposed in the base material 20. The hole 20*c* may be disposed in at least one of the first layer 20*a* and the second layer 20*b*. The hole 20*c* is disposed, for example, in the instep portion of the shoe 1. The hole 20*c* is disposed in a portion adjacent to the foot insertion opening 22 of the instep portion of the shoe 1. The number of holes 20*c* is, for example, two. The shape of the hole 20*c* is not particularly limited, but is, for example, an elliptical shape.

In the example illustrated in FIG. 3, the heel side end of the second portion 21*b* of the two linear bodies 21 closest to the shoe center axis C is exposed to the outside of the base material 20 from the hole 20*c*. Part or all of the second portion 21*b* of the at least one linear body 21 may be exposed to the outside of the base material 20.

As illustrated in FIGS. 2 and 3, the second portion 21*b* of the linear body 21 includes a portion formed of a cord or the like that is a separate body different from the other second portions 21*b*. That is, another member such as a cord may be disposed as a part of the second portion 21*b* of the linear body 21. In the example illustrated in FIG. 3, only this separate member may be exposed to the outside of the base material 20 and pulled.

In addition, the upper 2 can be manufactured by forming the base material 20 and forming the linear body 21 in one step using a dedicated machine. As a method for manufacturing the upper 2, the formation of the base material 20 and the formation of the linear body 21 are preferably performed in one step, but the formation of the base material 20 and the formation of the linear body 21 may be performed in separate steps.

Next, the outsole 31 will be described in detail.

Figure 7:
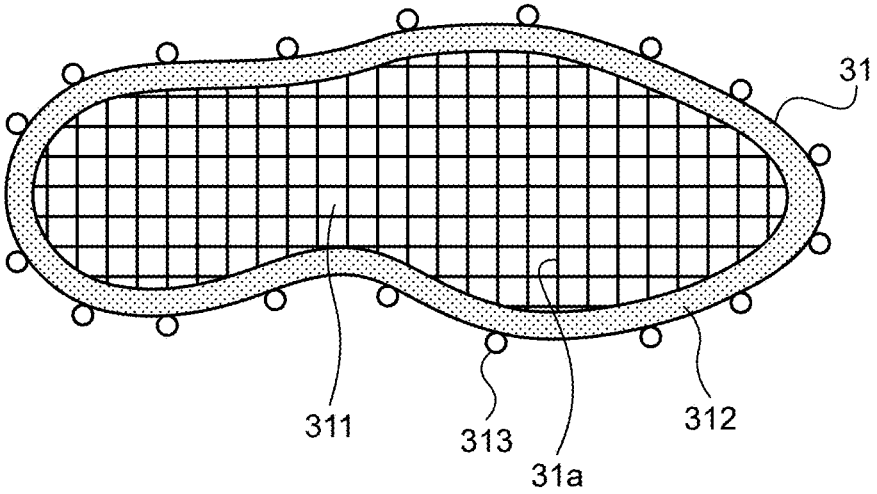
FIG. 7 is a bottom view illustrating an outsole of the shoe according to the first embodiment.
Figure 8:
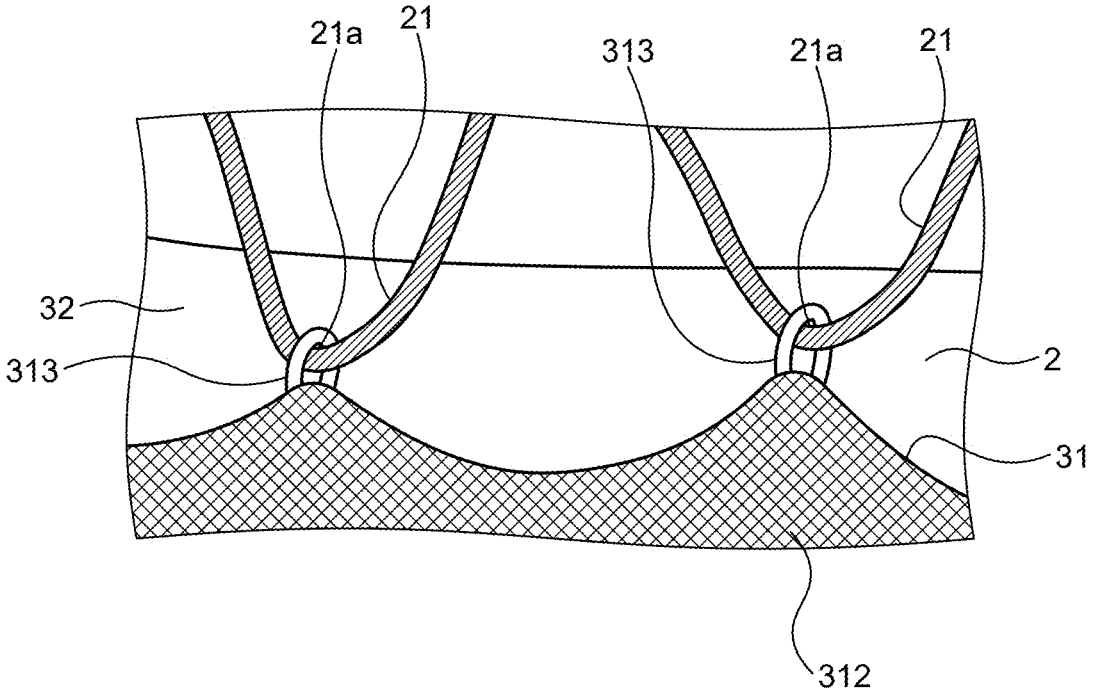
FIG. 8 is a side view illustrating a connecting portion of the outsole of the shoe according to the first embodiment.

FIG. 7 is a bottom view illustrating the outsole 31 of the shoe 1 according to the first embodiment. The outsole 31 is disposed on the entire or a part of the ground contact surface. FIG. 8 is a side view illustrating the connecting portion 313 of the outsole 31 of the shoe 1 according to the first embodiment. As illustrated in FIG. 7, the outsole 31 includes a plurality of linear elements 31*a*. The outsole 31 is, for example, a yarn obtained by bundling a plurality of fibers, a linear resin, a twisted yarn, or the like. The outsole 31 and the midsole 32 may be formed of a recyclable resin. The outsole 31 and the midsole 32 may be made of the same material or different materials. As a material of the outsole 31, for example, a polyurethane-based thermoplastic elastomer, polyurethane, nylon, spandex, Kevlar (registered trademark), ultra-high molecular weight polyethylene, SCY or DCY covering polyurethane, or the like is used.

The outsole 31 may be formed in a planar shape. The material of the outsole 31 is, for example, rubber. The outsole 31 (outsole 31A illustrated in FIG. 13) is made of, for example, a thermoplastic material. In the outsole 31A, for example, a bottom surface to be the ground contact surface 311 is formed in a planar shape, and there is no gap in the bottom surface.

The outsole 31 includes a bottom surface portion which is the ground contact surface 311, a side surface portion 312, and a connecting portion 313. The side surface portion 312 of the outsole 31 is positioned above the midsole 32 in a state where the outsole 31 is attached, and covers at least a part of the side surface of the midsole 32. The side surface portion 312 of the outsole 31 may cover at least a part of the upper 2. In the lower part of the upper 2, the outsole 31 is positioned outside the upper 2.

The connecting portion 313 is formed in, for example, a circular shape, a polygonal shape, or a hook shape. The connecting portion 313 is disposed on the outer edge of the side surface portion 312 of the outsole 31. A plurality of the connecting portions 313 are disposed around the outer edge of the side surface portion 312 of the outsole 31. As illustrated in FIG. 8, the linear body 21 of the upper 2 is inserted into the connecting portion 313. In the linear body 21, a portion inserted into the connecting portion 313 is the first portion 21*a* connected to the side surface portion 312 of the outsole 31.

Each of the plurality of linear bodies 21 has the first portion 21*a* connected to the side surface portion 312 of the outsole 31 and a second portion 21*b* where the plurality of adjacent linear bodies 21 are caught with each other. The first portions 21*a* of the plurality of linear bodies 21 are connected to the side surface portion 312 of the outsole 31, and the second portions 21*b* disposed at portions other than the first portions 21*a* are caught by each other. When the non-connected portion such as the third portion 21*e* of the linear body 21 is pulled, a tension T1 is transmitted to the second portion 21*b* of the plurality of adjacent linear bodies 21, the first portion 21*a*, and the side surface portion 312 of the outsole 31 in this order, and a tension T2 is finally applied to the outsole 31. Thus, the outsole 31 can be effectively fitted to the foot of the wearer of the shoe 1.

The outsole 31 is not adhered to the midsole 32. The outsole 31 is connected to the upper 2 by connection between the connecting portion 313 of the outsole 31 and the first portion 21*a* of the linear body 21. For example, the outsole 31 is connected to the upper 2 by inserting the linear body 21 into the connecting portion 313. In other words, the plurality of linear bodies 21 of the upper 2 are connected to the side surface portion 312 of the outsole 31 by being caught by the connecting portion 313. The outsole 31 is separated from the upper 2 by releasing the connection between the connecting portion 313 of the outsole 31 and the first portion 21*a* of the linear body 21. For example, the outsole 31 is separated from the upper 2 by pulling out the linear body 21 inserted into the connecting portion 313 from the connecting portion 313. This makes it possible to facilitate recycling.

The midsole 32 is not bonded to the upper 2. The outsole 31 is connected to the upper 2 and the midsole 32 by connection between the connecting portion 313 of the outsole 31 and the first portion 21*a* of the linear body 21. For example, the outsole 31 is connected to the upper 2 and the midsole 32 by inserting the linear body 21 into the connecting portion 313. In addition, the outsole 31 is separated from the upper 2 and the midsole 32 by releasing the connection between the connecting portion 313 of the outsole 31 and the first portion 21*a* of the linear body 21. For example, the outsole 31 is separated from the upper 2 and the midsole 32 when the linear body 21 inserted into the connecting portion 313 is pulled out from the connecting portion 313. This makes it possible to facilitate recycling.

The connection between the upper 2 and the outsole 31 by the first portion 21*a* of the linear body 21 and the connecting portion 313 of the outsole 31 is not limited to the method of inserting the linear body 21 into the connecting portion 313. For example, a portion into which the linear body 21 can be fitted may be disposed on the side surface portion 312 of the outsole 31, and the linear body 21 may be fitted to the fittable portion as a releasable connection means. In addition, for example, a connection means that can be released as a configuration using a hook-and-loop fastener may be used. Furthermore, for example, a connection means that can be released as a configuration of connecting with a string may be used.

When the outsole 31 is made of resin, the outsole 31 can be formed by resin printing. In the resin printing, the resin can be disposed linearly. When the outsole 31 is made of resin, the outsole 31 can be formed by a 3D printer. In the 3D printer, since the resin can be disposed linearly and the resin can be stacked in the height direction, the resin can be disposed three-dimensionally. When the outsole 31 includes the plurality of linear elements 31*a*, the outsole 31 can be formed by an embroidering machine.

Figure 9:
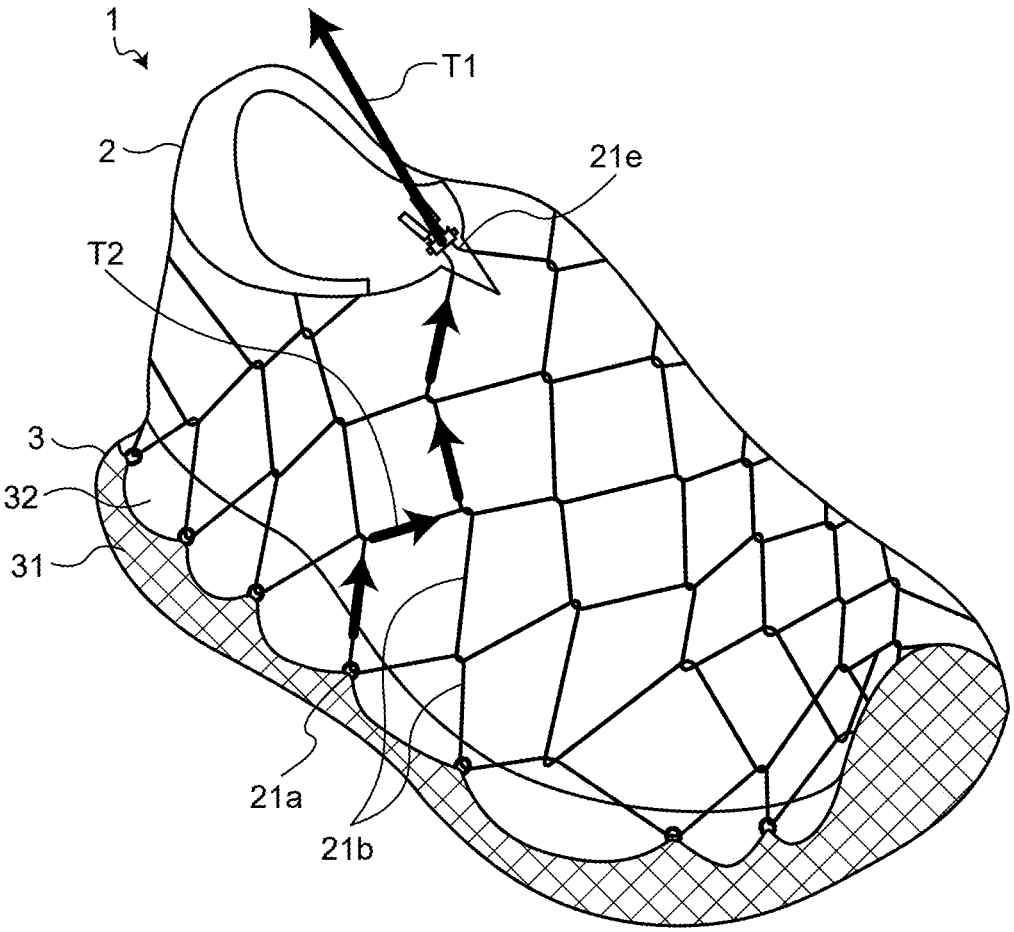
FIG. 9 is a perspective view illustrating the shoe according to the first embodiment, and is a view illustrating a state in which a linear body is pulled.
Figure 10:
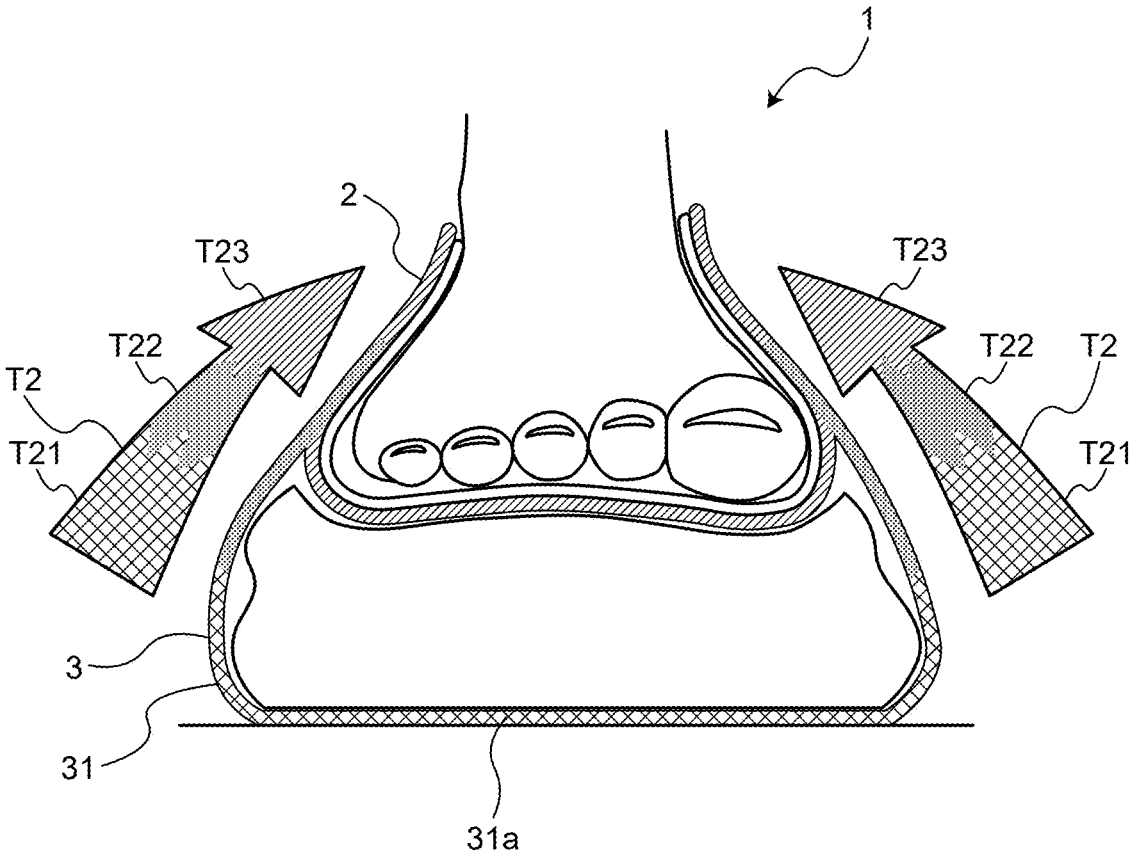
FIG. 10 is a front cross-sectional view illustrating the shoe according to the first embodiment, illustrating a state in which the linear body is pulled.

Next, the effect of the shoe 1 according to the present embodiment will be described with reference to FIGS. 9, 10, and the like. FIG. 9 is a perspective view illustrating the shoe 1 according to the first embodiment, and is a view illustrating a state in which the linear body 21 is pulled. FIG. 10 is a front cross-sectional view illustrating the shoe 1 according to the first embodiment, and is a view illustrating a state in which the linear body 21 is pulled.

In the present embodiment, as illustrated in FIG. 9, the plurality of linear bodies 21 have the first portion 21*a* connected to the side surface portion 312 of the outsole 31 and the second portion 21*b* where the plurality of adjacent linear bodies 21 are caught with each other. The first portions 21*a* of the plurality of linear bodies 21 are connected to the side surface portion 312 of the outsole 31. Therefore, as illustrated in FIG. 9, when the non-connected portion such as the third portion 21*e* of the linear body 21 is pulled, the tension T1 is transmitted to the second portion 21*b* of the plurality of adjacent linear bodies 21, the first portion 21*a*, and the side surface portion 312 of the outsole 31 in this order, and the tension T2 is finally applied to the outsole 31. As illustrated in FIG. 10, when the non-connected portion such as the third portion 21*e* of the linear body 21 is pulled, a tension T23 applied to the upper portion of the upper 2, a tension T22 applied to the lower portion of the upper 2, and a tension T21 applied to the outsole 31 are applied in this order, and the outsole 31 can be attracted to the upper 2 side. Thus, the outsole 31 can be effectively fitted to the foot of the wearer of the shoe 1.

In the present embodiment, as illustrated in FIG. 3 and the like, the upper 2 includes the first layer 20*a* and the second layer 20*b* disposed with a gap from the first layer 20*a*. The second portions 21*b* of the plurality of linear bodies 21 are positioned between the first layer 20*a* and the second layer 20*b*. Thus, the plurality of linear bodies 21 can be protected. As illustrated in FIGS. 1 and 2, the second portions 21*b* of the plurality of linear bodies 21 may be positioned on the surface of the layer 20*a* (first layer 20*a*).

In the present embodiment, as illustrated in FIG. 9, at least one of the plurality of linear bodies 21 includes the third portion 21*e* that is disposed in at least one end portion of the linear body 21 along the length direction and applies the tension T2 to the upper 2 to the outsole 31 in a pulled state. The third portion 21*e* facilitates application of the tension T2 to the outsole 31, and the outsole 31 can be effectively attracted to the upper 2 side.

In the present embodiment, as illustrated in FIG. 9, the side surface portion 312 of the outsole 31 may cover at least a part of the upper 2. The side surface portion 312 of the outsole 31 is positioned on the upper portion of the midsole 32 in a state where the outsole 31 is attached. That is, the side surface portion 312 of the outsole 31 is connected to the first portions 21*a* of the plurality of linear bodies 21 on the upper 2. Thus, the tension T1 can be easily applied to the plurality of linear bodies 21, and the outsole 31 can be effectively attracted to the upper 2 side.

Since the outsole 31 and the midsole 32 are not bonded to the upper 2, the linear body 21 of the upper 2 is pulled out from the connecting portion 313 of the outsole 31, so that the outsole 31 and the midsole 32 can be easily separated from the upper 2. This makes it possible to facilitate recycling.

Second Embodiment

Figure 11:
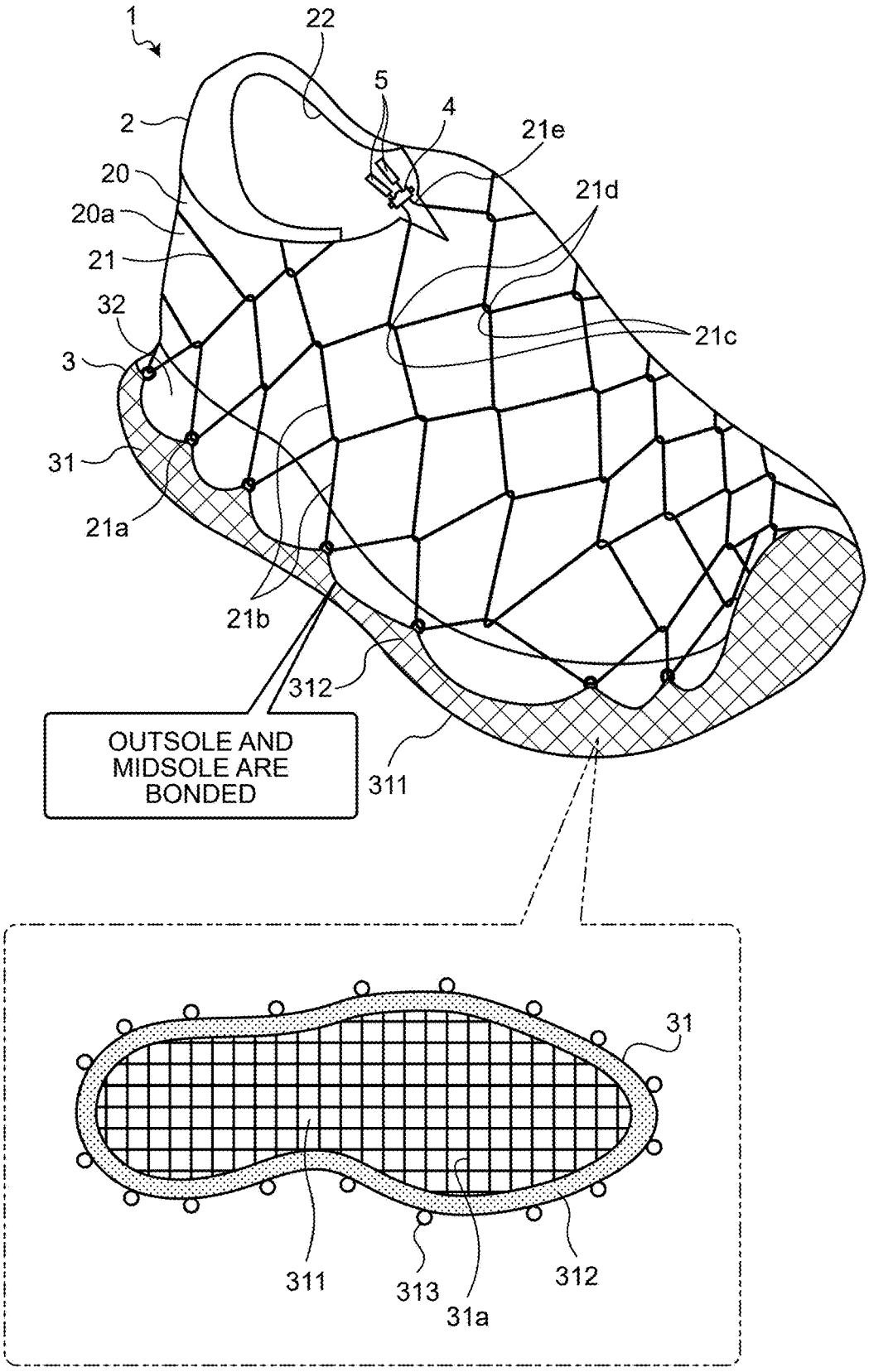
FIG. 11 is a perspective view illustrating a shoe according to a second embodiment.

FIG. 11 is a perspective view illustrating a shoe 1 according to a second embodiment. The shoe 1 according to the second embodiment is different from the shoe 1 according to the first embodiment in that the outsole 31 and the midsole 32 are bonded. Note that description of configurations common to the first embodiment in the second embodiment will be omitted.

As illustrated in FIG. 11, the outsole 31 includes a plurality of linear elements 31*a* as in the first embodiment. The outsole 31 is bonded to at least one of the bottom surface and the side surface of the midsole 32.

The present embodiment can achieve the same effects as those of the first embodiment. Also in the present embodiment, the fit feeling of the outsole 31 (particularly, the side surface portion 312 of the outsole 31) with respect to the midsole 32 and the upper 2 can be improved by connecting the outsole 31 and the upper 2 by the connecting portion 313. Further, since the outsole 31 and the midsole 32 are not bonded to the upper 2, as in the first embodiment, the linear body 21 of the upper 2 is pulled out from the connecting portion 313 of the outsole 31, so that the outsole 31 and the midsole 32 can be easily separated from the upper 2. This makes it possible to facilitate recycling.

Third Embodiment

Figure 12:
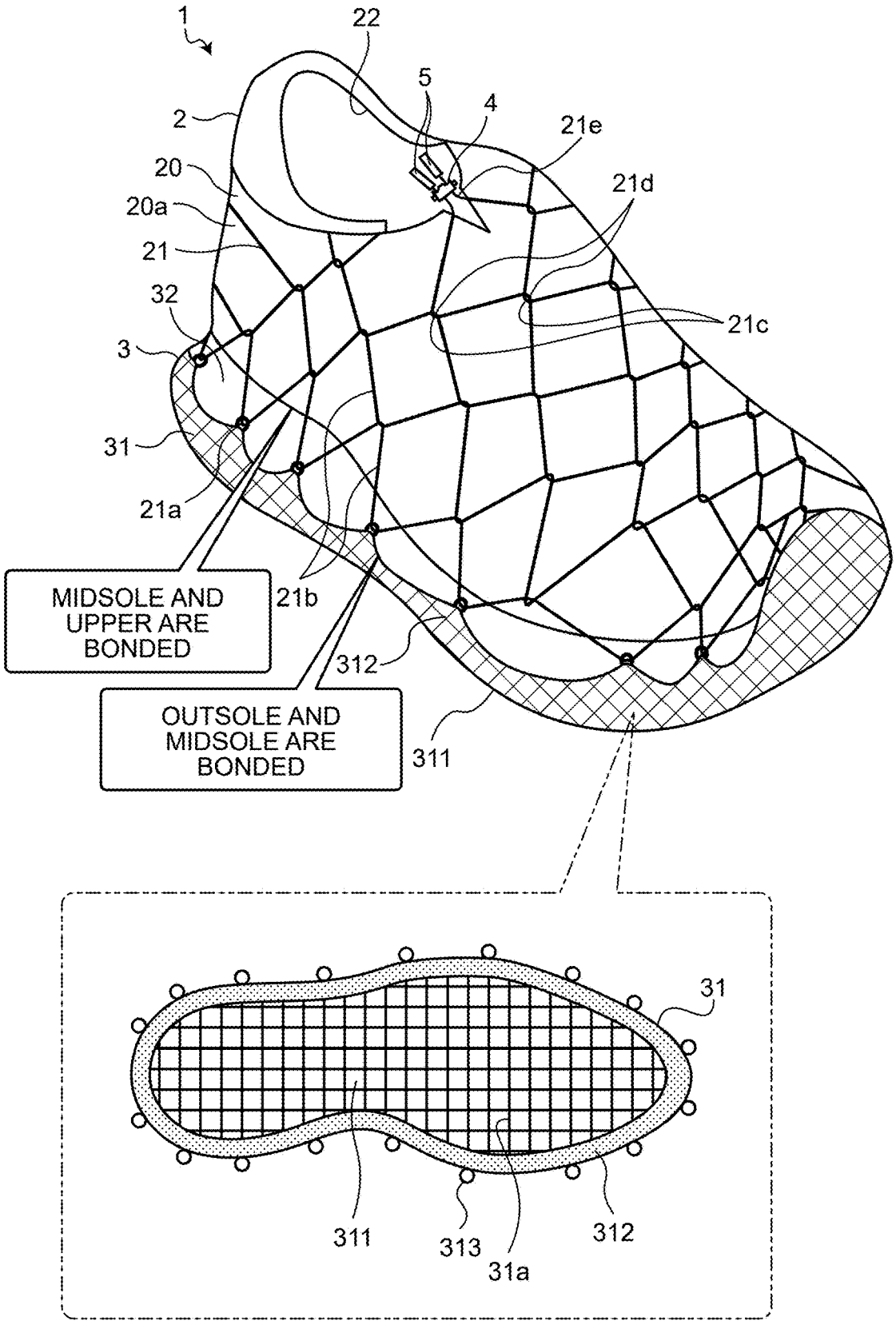
FIG. 12 is a perspective view illustrating a shoe according to a third embodiment.

FIG. 12 is a perspective view illustrating a shoe 1 according to a third embodiment. The shoe 1 according to the third embodiment is different from the shoe 1 according to the first embodiment in that the outsole 31 and the midsole 32 are bonded, and the midsole 32 and the upper 2 are bonded. Note that the description of the configuration common to the first embodiment in the third embodiment may be omitted.

As illustrated in FIG. 12, the outsole 31 includes a plurality of linear elements 31*a* as in the first embodiment. In the outsole 31, the upper surface of the outsole 31 is bonded to the bottom surface of the midsole 32 by welding or the like. In the outsole 31, the side surface portion 312 of the outsole 31 may be bonded to the side surface of the midsole 32 by welding or the like. In the midsole 32, the upper surface of the midsole 32 is bonded to the bottom surface of the upper 2 by welding or the like. In the third embodiment, the outsole 31 and the upper 2 are connected by engagement of the connecting portion 313 of the outsole 31 and the first portion 21*a*.

The means for connecting the outsole 31 and the upper 2 by the first portion 21*a* is not limited to the means for inserting the linear body 21 into the connecting portion 313. For example, a portion into which the linear body 21 can be fitted may be disposed on the side surface portion 312 of the outsole 31, and the linear body 21 may be fitted to the fittable portion as a releasable connection means. In addition, for example, a connection means that can be released as a configuration using a hook-and-loop fastener may be used. Furthermore, for example, a connection means that can be released as a configuration of connecting with a string may be used.

When the outsole 31 is made of resin, the outsole 31 can be formed by resin printing. In the resin printing, the resin can be disposed linearly. When the outsole 31 is made of resin, the outsole 31 can be formed by a 3D printer. In the 3D printer, since the resin can be disposed linearly and the resin can be stacked in the height direction, the resin can be disposed three-dimensionally. When the outsole 31 includes the plurality of linear elements 31*a*, the outsole 31 can be formed by an embroidering machine.

In the present embodiment, the outsole 31 and the midsole 32 are bonded, and the midsole 32 and the upper 2 are bonded, but by connecting the outsole 31 and the upper 2 by the connecting portion 313, it is possible to improve the fit feeling of the outsole 31 (particularly, the side surface portion 312 of the outsole 31) with respect to the midsole 32 and the upper 2.

Fourth Embodiment

Figure 13:
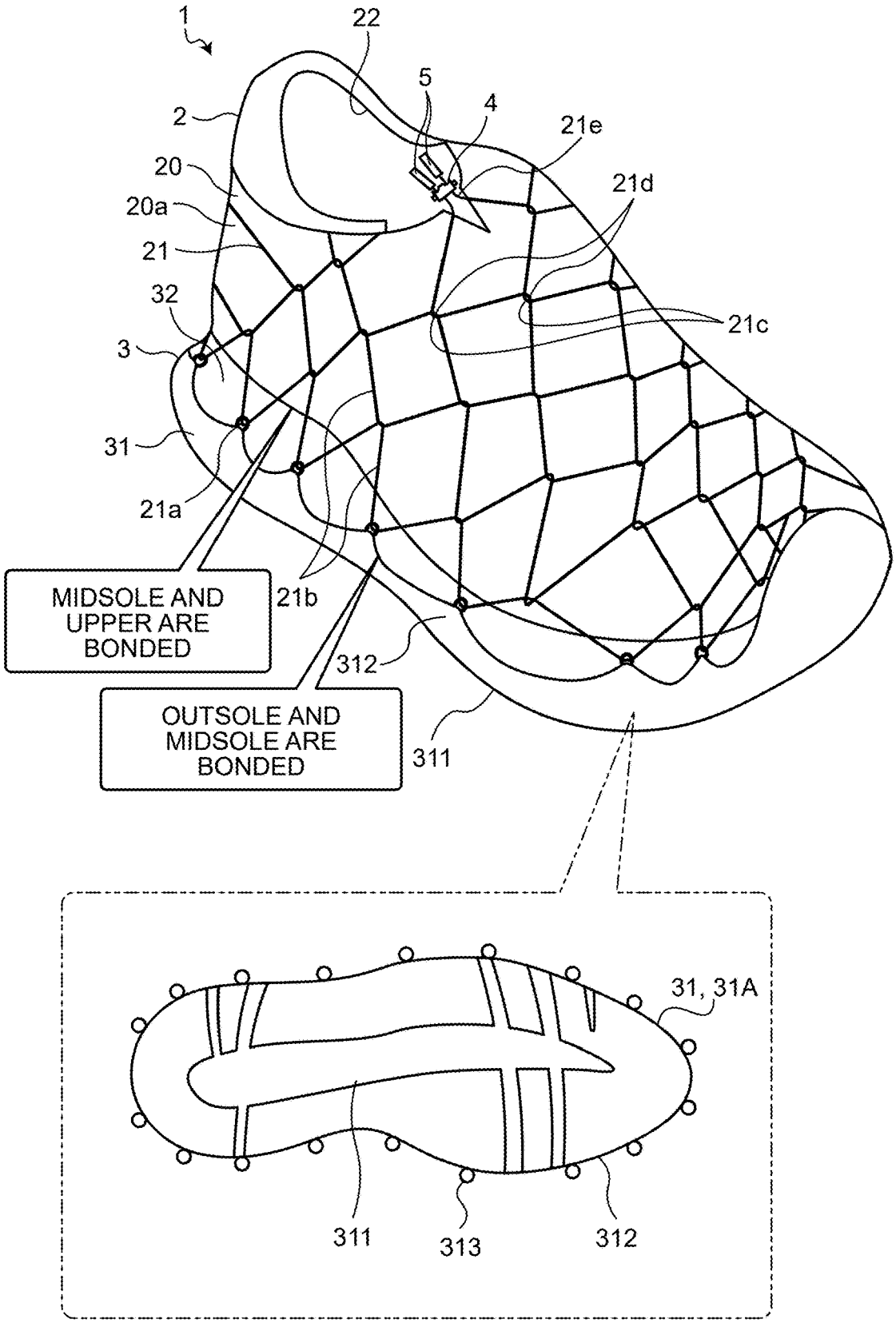
FIG. 13 is a perspective view illustrating a shoe according to a fourth embodiment.

FIG. 13 is a perspective view illustrating a shoe 1 according to a fourth embodiment. The shoe 1 according to the fourth embodiment is different from the shoe 1 according to the first embodiment in that the outsole 31 is made of rubber, the outsole 31 and the midsole 32 are bonded, and the midsole 32 and the upper 2 are bonded. Note that the description of the configuration common to the first embodiment in the fourth embodiment may be omitted.

As illustrated in FIG. 13, the outsole 31 (outsole 31A) is made of a thermoplastic material. The outsole 31A is made of synthetic rubber. In the outsole 31A, a bottom surface to be the ground contact surface 311 is disposed in a planar shape. In the fourth embodiment, unlike the outsole 31 including the plurality of linear bodies 21 illustrated in FIG. 1 and the like, the outsole 31A has no gap in the bottom surface.

As illustrated in FIG. 13, in the outsole 31A, the upper surface of the outsole 31A is bonded to the bottom surface of the midsole 32 by welding or the like. In the outsole 31A, the side surface portion 312 of the outsole 31A may be bonded to the side surface of the midsole 32 by welding or the like. In the midsole 32, the upper surface of the midsole 32 is bonded to the bottom surface of the upper 2 by welding or the like. In the fourth embodiment, the outsole 31A and the upper 2 are connected by engagement between the connecting portion 313 of the outsole 31A and the first portion 21*a*.

The means for connecting the outsole 31A and the upper 2 by the first portion 21*a* is not limited to the means for inserting the linear body 21 into the connecting portion 313. For example, a portion to which the linear body 21 can be fitted may be disposed on the side surface portion 312 of the outsole 31A, and the linear body 21 may be fitted to the fittable portion as a releasable connection means. In addition, for example, a connection means that can be released as a configuration using a hook-and-loop fastener may be used. Furthermore, for example, a connection means that can be released as a configuration of connecting with a string may be used.

In the present embodiment, the outsole 31A and the midsole 32 are bonded, and the midsole 32, and the upper 2 are bonded, but by connecting the outsole 31A and the upper 2 by the connecting portion 313, it is possible to improve the fit feeling of the outsole 31A (particularly, the side surface portion 312 of the outsole 31A) with respect to the midsole 32 and the upper 2.

Fifth Embodiment

Figure 14:
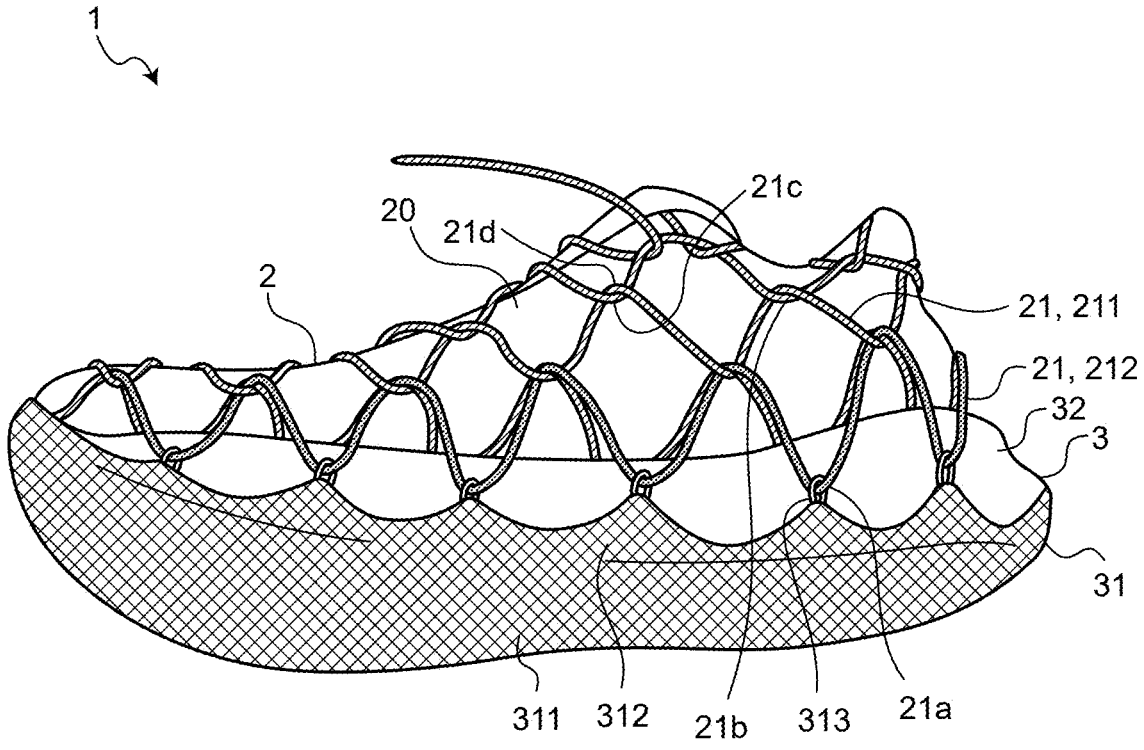
FIG. 14 is a perspective view illustrating a shoe according to a fifth embodiment.

FIG. 14 is a perspective view illustrating a shoe 1 according to a fifth embodiment. The shoe 1 according to the fifth embodiment is different from the shoe 1 according to the first embodiment in that the plurality of linear bodies 21 include a first linear body 211 and a second linear body 212.

As illustrated in FIG. 14, the upper 2 includes a cloth-like base material 20 having one layer 20*a*. The plurality of linear bodies 21 are exposed on the surface of the upper 2. The plurality of linear bodies 21 include a plurality of first linear bodies 211 and a second linear body 212. The first linear body 211 is similar to the linear body 21 of the first embodiment, and has a second portion 21*b*. The second portions 21*b* of the adjacent first linear bodies 211 are caught with each other. As illustrated in FIG. 14, the first linear bodies 211 extend in a zigzag shape alternately protruding from the fore toward the rear to one side and the other side in the foot width direction.

Similarly to FIG. 6, in the second portion 21*b* of the first linear body 211, a first hook portion 21*c* hooked to another first linear body 211 disposed on one side along the foot width direction and a second hook portion 21*d* hooked to another first linear body 211 disposed on the other side along the foot width direction are alternately disposed in the foot length direction. In the adjacent first linear bodies 211, the first hook portion 21*c* and the second hook portion 21*d* are hooked. In the first linear body 211 positioned at the most end in the foot width direction, one of the first hook portion 21*c* and the second hook portion 21*d* is connected to the outer edge of the base material 20. In the present exemplary embodiment, first linear bodies 211 are disposed such that a portion surrounded by two adjacent first linear bodies 211 forms a rhombus.

Figure 16:
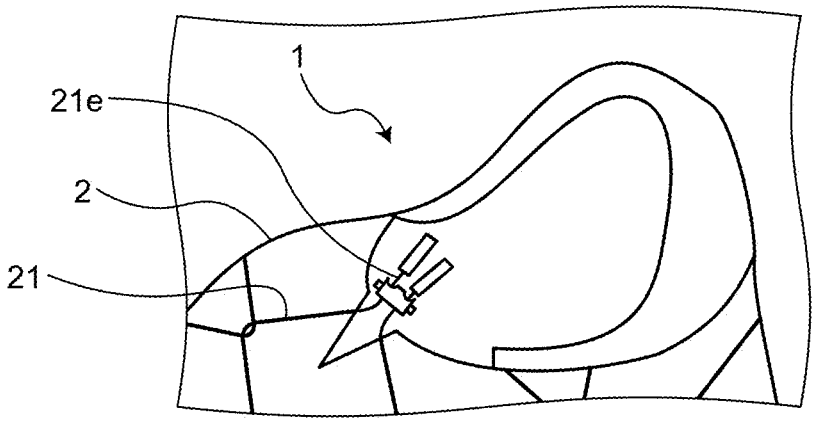
FIG. 16 is a view illustrating a third portion in the shoe according to the fifth embodiment and the sixth embodiment.

FIG. 16 is a view illustrating a third portion in the shoes 1 according to the fifth embodiment and the sixth embodiment. As illustrated in FIG. 16, at least one of the plurality of first linear bodies 211 has a third portion 21*e* that applies tension to the upper 2 to the outsole 31 in a state of being pulled from the fore to the rear of the shoe 1. The third portion 21*e* is disposed in at least one end portion of the first linear body 211 along the length direction.

The second linear body 212 is connected to the first linear body 211 on the surface of the upper 2. The second linear body 212 is positioned between the outsole 31 and the upper 2. The second linear body 212 may be positioned between the midsole 32 and the upper 2. The second linear body 212 is at least one linear body, and has a first portion 21*a* for connecting the outsole 31 and the upper 2.

The present embodiment can achieve the same effects as those of the first embodiment. In the present embodiment, it is possible to improve the fit feeling of the outsole 31 with respect to the midsole 32 and the upper 2. In addition, since the outsole 31 and the upper 2 are not adhered to each other, the outsole 31 and the upper 2 can be easily separated, so that recycling can be facilitated.

Sixth Embodiment

Figure 15:
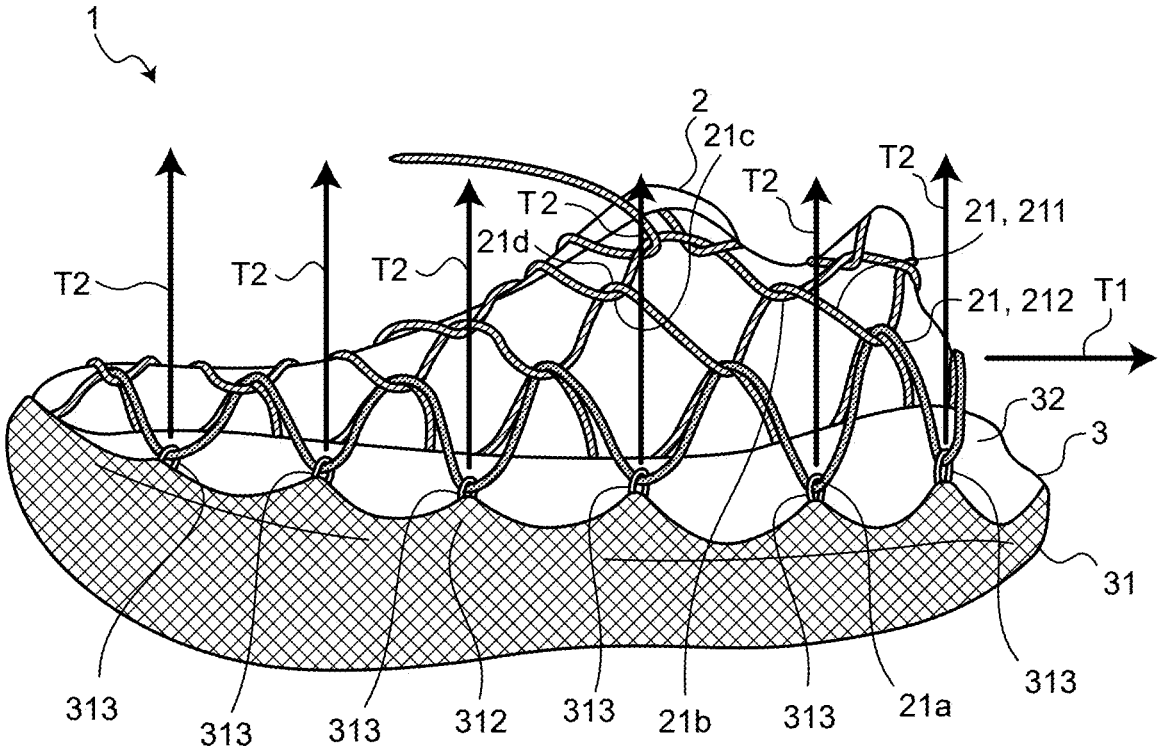
FIG. 15 is a perspective view illustrating a shoe according to a sixth embodiment.

FIG. 15 is a perspective view illustrating a shoe 1 according to a sixth embodiment. FIG. 15 is a view illustrating a state in which the linear body 21 is pulled. The shoe 1 according to the sixth embodiment is different from the shoe 1 according to the first embodiment in that the plurality of linear bodies 21 include the first linear body 211 and the second linear body 212, similarly to the fifth embodiment. The shoe 1 according to the sixth embodiment is different from the fifth embodiment in the direction of the tension T1 when the second linear body 212 is pulled.

As illustrated in FIG. 15, in the present embodiment, when at least one second linear body 212 is pulled in one direction (for example, rear) and the tension T1 is generated, the tension T2 is applied from the connecting portion 313 of the outsole 31 connected to the first portion 21*a* of the second linear body 212 toward the upper 2 positioned above the outsole 31. The second linear body 212 is independent of the first linear body 211, and the tension T2 can be directly applied to the connecting portion 313 of the outsole 31 by pulling the second linear body 212. As described above, in the present embodiment, the tension T2 is directly applied to the connecting portion 313 of the outsole 31 by the tension T1, and the outsole 31 can be attracted toward the upper 2 side. Thus, the outsole 31 can be effectively fitted to the foot of the wearer of the shoe 1.

As illustrated in FIG. 16, also in the present embodiment, as in the fifth embodiment, at least one of the plurality of first linear bodies 211 has a third portion 21*e* that applies tension to the upper 2 to the outsole 31 in a state of being pulled from the fore to the rear of the shoe 1. The third portion 21*e* is disposed in at least one end portion of the first linear body 211 along the length direction.

For example, one second linear body 212 may be disposed on at least one of the media side or the lateral side of the shoe 1, or two second linear bodies may be disposed on the media side and the lateral side of the shoe 1. The second linear body 212 may have the third portion 21*e* that applies tension to the upper 2 to the outsole 31 in a state of being pulled from the fore to the rear of the shoe 1. The third portion 21*e* is disposed in at least one end portion of the second linear body 212 along the length direction.

A surface of the upper 2 is connected to the first linear body 211. The second linear body 212 is positioned between the outsole 31 and the upper 2. The second linear body 212 may be positioned between the midsole 32 and the upper 2. The second linear body 212 is at least one linear body, and has a first portion 21*a* for connecting the outsole 31 and the upper 2.

Other Embodiments

In the shoe 1 according to the above embodiment, the connecting portion 313 of the outsole 31 may be disposed so as to be in contact with the side surface of the midsole 32 and disposed on the upper portion of the side surface of the midsole 32 on the upper 2 side of the side surface of the midsole 32.

In the shoe 1 according to the above embodiment, some of the plurality of linear bodies 21 of the upper 2 may be connected to the base material 20 of the upper 2, and the linear body 21 connected to the base material 20 may be hooked on the connecting portion 313 to be connected to the side surface portion 312 of the outsole 31. Such a configuration is not, for example, a configuration of obtaining the tension T1 by pulling the third portion 21*e* as in the shoe 1 according to the first embodiment. Even with such a configuration, the outsole 31 can be easily separated. This makes it possible to facilitate recycling.

Figure 17:
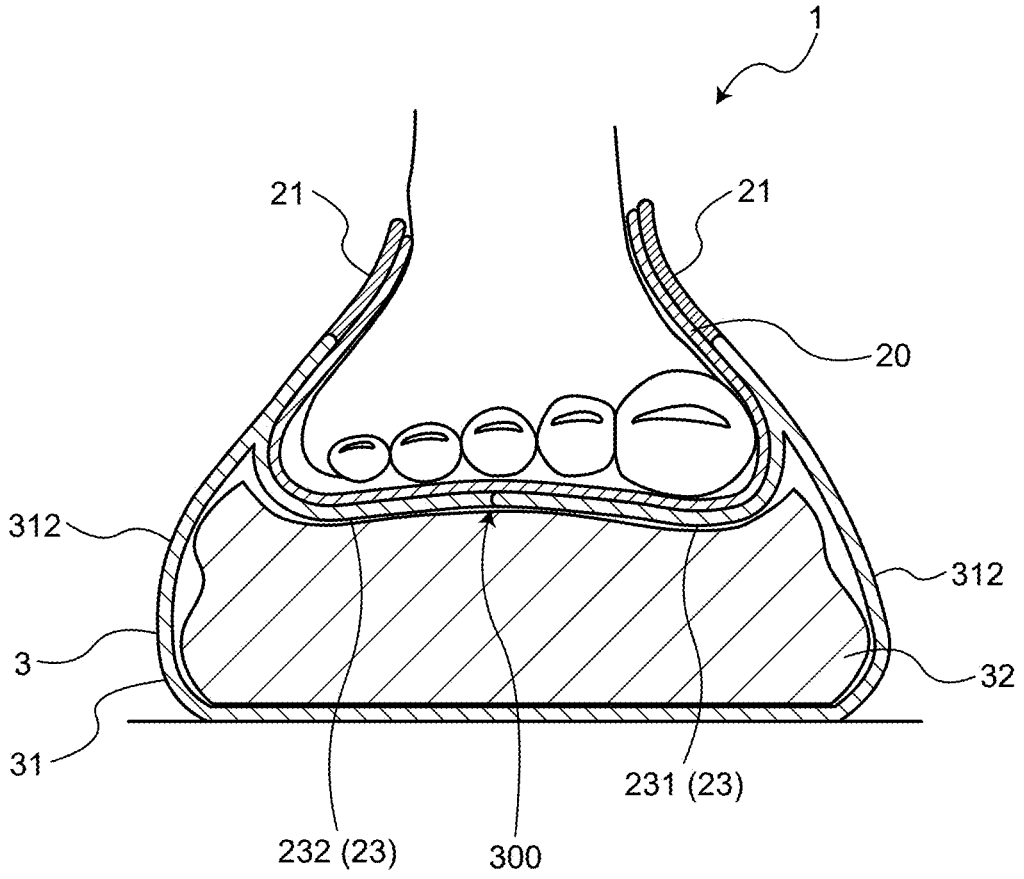
FIG. 17 is a front cross-sectional view illustrating a shoe according to another embodiment.

FIG. 17 is a front cross-sectional view illustrating a shoe 1 according to another embodiment. Also in FIG. 17, the same portions are denoted by the same reference numerals as those of the shoe 1 according to the embodiment described above. As illustrated in FIG. 17, in the shoe 1 according to the embodiment, a linear body 23 different from the linear body 21 may be disposed on the medial side and the lateral side of the outsole 31. Each of a linear body 231 on the medial side and a linear body 232 on the lateral side of the outsole 31 may be at least one. By connecting the linear body 231 on the medial side and the linear body 232 on the lateral side of the outsole 31 to each other at a connecting portion 300 between the base material 20 and the midsole 32, the outsole 31 can be fixed to the midsole 32, so that the outsole 31 can be more effectively fitted to the foot of the wearer of the shoe 1.

In the shoe 1 according to the above embodiment, the outsole 31 may be formed of a resin that can be recycled at the same time as the midsole 32 or the upper 2. This makes it possible to facilitate recycling. In the shoe 1 according to the above embodiment, the outsole 31 covers the midsole 32 from below, and can be used as a welding margin with the upper 2.

In the shoe 1 according to the above embodiment, the outsole 31 may be formed of natural rubber. In the shoe 1 according to the above embodiment, the outsole 31 may be formed of synthetic rubber. In the shoe 1 according to the above embodiment, the outsole 31 may include the linear element 31*a* made of a plurality of types of materials. Thus, the connecting portion 313 of the outsole 31 can be easily manufactured.

Furthermore, in the shoe 1 according to the above-described embodiment, the outsole 31 may be formed by any of resin printing, a 3D printer, and an embroidering machine. When the outsole 31 is made of resin, the connecting portion 313 between the outsole 31 and the outsole 31 can be easily manufactured. In the shoe 1 according to the above embodiment, at least two of the upper 2, the midsole 32, and the outsole 31 may be formed of the same recyclable resin. This makes it possible to facilitate recycling.

According to the present disclosure, it is possible to improve the fit feeling of the outsole with respect to the midsole and the upper.

Although the present disclosure has been described in detail above, the present disclosure is not limited to the above embodiments, and various modifications, improvements, and the like can be made without departing from the gist of the present disclosure.

It should be understood that the embodiments disclosed herein are illustrative in all respects and not restrictive. Indeed, the above embodiments may be embodied in a variety of forms. The above embodiments may be omitted, replaced, or modified in various forms without departing from the scope and spirit of the appended claims.

Note that the present technology can also have the following configurations.

(1) A shoe comprising:

an outsole having a ground contact surface;

a midsole positioned above the outsole;

an upper positioned above the outsole and the midsole and covering at least a part of a foot of a wearer; and a plurality of linear bodies disposed in the upper, the plurality of linear bodies extending in a first direction and extending in a second direction intersecting the first direction, wherein the outsole includes a side surface portion extending from the ground contact surface and covering at least a part of a side surface of the midsole, and the plurality of linear bodies include a first portion connected to the side surface portion of the outsole, and a second portion which is disposed in a portion other than the first portion and in which the plurality of linear bodies adjacent to each other are caught by each other.

(2) The shoe according to claim 1, wherein the upper has one layer, and the plurality of linear bodies are exposed on a surface of the upper.

(3) The shoe according to claim 1, wherein the upper includes a first layer and a second layer disposed with a gap from the first layer, and the second portion of each of the plurality of linear bodies is positioned between the first layer and the second layer.

(4) The shoe according to claims 1 to 3, wherein at least one of the plurality of linear bodies includes a third portion that is disposed in at least one end portion of each of the linear bodies along a length direction and applies tension to the upper to the outsole in a state of being pulled from a fore to a rear of the shoe.

(5) The shoe according to claims 1 to 4, wherein the side surface portion of the outsole covers at least a part of the upper.

(6) The shoe according to claims 1 to 5, wherein the outsole is not bonded to the midsole, is connected to the upper by connection between the side surface portion of the outsole and the first portion, and is separated from the upper by disconnection between the side surface portion of the outsole and the first portion.

(7) The shoe according to claims 1 to 6, wherein the midsole is not bonded to the upper, is connected to the upper by connection between the side surface portion of the outsole and the first portion, and is separated from the upper by disconnection between the side surface portion of the outsole and the first portion.

(8) The shoe according to claims 1 to 7, wherein the linear bodies include a first linear body that has a second portion, and at least one second linear body that is connected to the first linear body, positioned between the midsole or the outsole and the upper, and has the first portion.

(9) The shoe according to claim 8, wherein the second linear body applies tension toward the upper side in the first portion connected to the side surface portion of the outsole.

(10) The shoe according to claims 1 to 9, wherein the outsole is formed of a resin that can be recycled at the same time as the midsole.

(11) The shoe according to claims 1 to 10, wherein the outsole is made of a thermoplastic raw material, the side surface portion of the outsole is positioned above the midsole, and the side surface portion of the outsole is welded to the midsole to connect the upper and the midsole.

(12) The shoe according to claims 1 to 11, wherein the outsole includes a plurality of linear elements.

(13) The shoe according to claim 12, wherein the outsole is formed of a yarn.

(14) The shoe according to claims 1 to 11, wherein the outsole is formed of natural rubber.

(15) The shoe according to claims 1 to 11, wherein the outsole is formed of synthetic rubber.

(16) The shoe according to claims 1 to 13, wherein the outsole is formed by resin printing.

(17) The shoe according to claims 1 to 14, wherein the outsole is formed by a 3D printer.

(18) The shoe according to claim 12 or 13, wherein the outsole is formed by an embroidering machine.

What is claimed is:

1. A shoe comprising:

an outsole having a ground contact surface;

a midsole positioned above the outsole;

an upper positioned above the outsole and the midsole and covering at least a part of a foot of a wearer; and a plurality of linear bodies disposed in the upper, the plurality of linear bodies extending in a first direction and extending in a second direction intersecting the first direction, wherein the outsole includes a side surface portion extending from the ground contact surface and covering at least a part of a side surface of the midsole, and a plurality of connecting portions disposed on an outer edge of the side surface portion, and the plurality of linear bodies each include a first portion movably connected to one of the plurality of connecting portions on the side surface portion of the outsole, and a second portion which is disposed in a portion other than the first portion and in which the plurality of linear bodies adjacent to each other are caught by each other.

2. The shoe according to claim 1, wherein the upper has one layer, and the plurality of linear bodies are exposed on a surface of the upper.

3. The shoe according to claim 1, wherein the upper includes a first layer and a second layer disposed with a gap from the first layer, and the second portion of each of the plurality of linear bodies is positioned between the first layer and the second layer.

4. The shoe according to claim 1, wherein at least one of the plurality of linear bodies includes a third portion that is disposed in at least one end portion of each of the plurality of linear bodies along a length direction and applies tension to the upper to the outsole in a state of being pulled from a fore to a rear of the shoe.

5. The shoe according to claim 1, wherein the side surface portion of the outsole covers at least a part of the upper.

6. The shoe according to claim 1, wherein the outsole is not bonded to the midsole, and is connected to the upper by the connection between the side surface portion of the outsole and the first portion.

7. The shoe according to claim 1, wherein the midsole is not bonded to the upper, and is connected to the upper by the connection between the side surface portion of the outsole and the first portion.

8. The shoe according to claim 1, wherein the plurality of linear bodies include a first linear body that has the second portion, and at least one second linear body that is connected to the first linear body, positioned between the midsole or the outsole and the upper, and has the first portion.

9. The shoe according to claim 8, wherein the second linear body applies tension toward the upper side in the first portion connected to the side surface portion of the outsole.

10. The shoe according to claim 1, wherein the outsole is formed of a resin that can be recycled at the same time as the midsole.

11. The shoe according to claim 1, wherein the outsole is made of a thermoplastic raw material, the side surface portion of the outsole is positioned above the midsole, and the side surface portion of the outsole is welded to the midsole to connect the upper and the midsole.

12. The shoe according to claim 1, wherein the outsole includes a plurality of linear elements.

13. The shoe according to claim 12, wherein the outsole is formed of a yarn.

14. The shoe according to claim 12, wherein the outsole is formed by an embroidering machine.

15. The shoe according to claim 1, wherein the outsole is formed of natural rubber.

16. The shoe according to claim 1, wherein the outsole is formed of synthetic rubber.

17. The shoe according to claim 1, wherein the outsole is formed by resin printing.

18. The shoe according to claim 1, wherein the outsole is formed by a 3D printer.

19. The shoe according to claim 1, wherein the connecting portions each have a closed loop shape, a polygonal shape, or a hook shape into which the first portion of one of the plurality of linear bodies is inserted.

* * * * *